United States Patent [19]

Steiner et al.

[11] Patent Number: 4,596,183

[45] Date of Patent: Jun. 24, 1986

[54] METHOD OF MEASURING THE PRINTING PRESSURE IN A PRINTING MACHINE

[75] Inventors: Gerd Steiner, Heusenstamm; Winfried Hartung, Offenbach; Valentin Gensheimer, Mülheim, all of Fed. Rep. of Germany

[73] Assignee: M.A.N.-Roland Druckmaschinen Aktiengesellschaft, Fed. Rep. of Germany

[21] Appl. No.: 750,884

[22] Filed: Jul. 1, 1985

[30] Foreign Application Priority Data

Jul. 5, 1984 [DE] Fed. Rep. of Germany ..... 3424723

[51] Int. Cl.[4] ..... B41F 13/34

[52] U.S. Cl. ..... 101/216

[58] Field of Search ..... 101/216, 217, 218, 152, 101/153, 136–140, 141, 142, 174, 247; 100/43, 47, 99, 163 A, 164, 165, 168, 169, 170; 73/862.45, 862.47, 862.48, 862.55

[56] References Cited

U.S. PATENT DOCUMENTS 4,351,237 9/1982 Tappert et al. ..... 101/216

FOREIGN PATENT DOCUMENTS 23542 2/1981 European Pat. Off. ..... 101/152
23541 2/1981 European Pat. Off. ..... 101/152
3008230 10/1980 Fed. Rep. of Germany .
2034828 6/1980 United Kingdom ..... 101/152

*Primary Examiner*—J. Reed Fisher
*Attorney, Agent, or Firm*—Leydig, Voit & Mayer, Ltd.

[57] ABSTRACT

A force or movement sensor is disposed on or proximate to an impression cylinder of a sheet-fed printing machine in order to sense the printing pressure. The sensor is sampled in synchronism with the rotation of the impression cylinder and the feeding of the sheets in order to detect a first pressure signal when pressure is applied to the fed sheets, and to detect a second pressure signal when the impression cylinder is relieved of the printing pressure. The differential value of the first and second pressure signals is displayed as an output or is evaluated by a pressure control system. As a result, static and quasi-static disturbances are suppressed. The mesurement is not affected by wear of the cylinder bearings or journals, variations in machine speed, and zero-point shift in the sensor and its associated electronics. These disturbances are further suppressed by averaging or accumulating samples over sample intervals and over a number of revolutions of the impression cylinder. Also, by proper synchronization of the sampling intervals with the feeding of sheets to the impression cylinder, the method can be used in a two-color rotary press for separately determining and independently controlling the pressures from the top and bottom ink transfer cylinders in response to a single sensor at the impression cylinder.

15 Claims, 12 Drawing Figures

FIG. 3
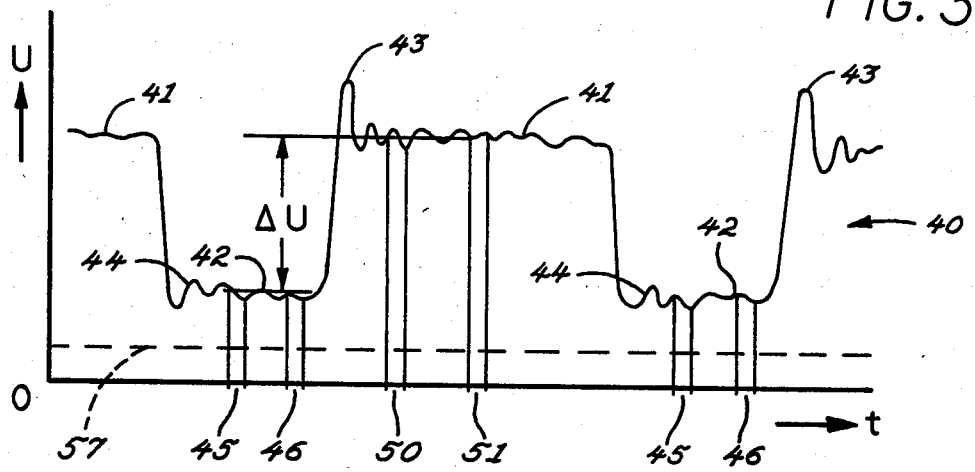
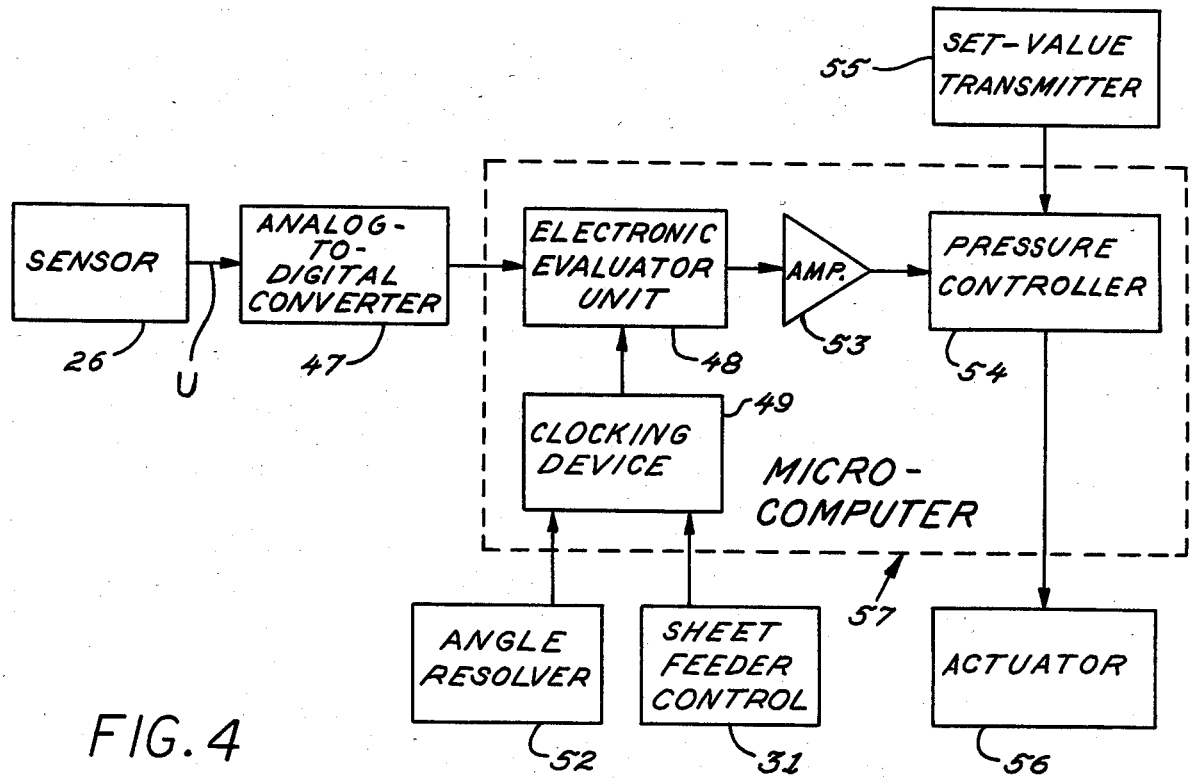
FIG. 4

METHOD OF MEASURING THE PRINTING PRESSURE IN A PRINTING MACHINE

BACKGROUND OF THE INVENTION

1. Technical Field

The present invention relates to a method of measuring the printing pressure between two cylinders of a printing machine. More particularly, the invention relates to a method of measuring the printing pressure between the ink transfer or blanket cylinder and the impression cylinder of a rotary printing press by using a force or displacement sensor disposed on or proximate to the impression cylinder.

2. Background Art

A control system of this kind is disclosed in Tappert et al., U.S. Pat. No. 4,351,237. The output signal of a piezoelectric pressure sensor mounted on the internal surface of an impression cylinder bearing is fed to a signal processing stage connected to a clock unit. The clock unit receives a signal proportional to the angle of rotation of the impression cylinder, and the measuring operation is controlled by the clock signal and a sheet movement control signal. In this fashion, the output signal of the pressure sensor is sampled according to the angle of rotation, but the sampling is performed only in the angle or phase range corresponding to the maximum printing pressure. The sampled value is compared with the set-value of a set-value transmitter in a discriminator for increasing or decreasing the printing pressure in response to the comparison.

SUMMARY OF THE INVENTION

The primary object of the invention is to provide a method of measuring printing pressure which is not affected by disturbances such as wear of the cylinder bearings or journals, variations in machine speed, and zero-point shift in the pressure sensor and its associated electronics.

Another object of the invention is to provide a method for use in a two-color rotary press for determining the pressure from the top and bottom ink transfer cylinders separately even though the pressure is measured at the impression cylinder, so that the pressure from the top and bottom ink transfer cylinders can be controlled independently of each other.

Briefly, in accordance with an important aspect of the invention, the sampling of a pressure sensor is carried out in synchronism with the rotation of the impression cylinder and the feeding of sheets to be printed in order to detect a first pressure signal when printing pressure is applied to the fed sheets, and to obtain a second pressure signal when the impression cylinder is relieved of the printing pressure, for example, during gaps in the stream of sheets fed through the printing machine. The differential value of these two signals is displayed as an output or is evaluated by a pressure control system. Since this detecting method is responsive to the differential value of printing pressure, static and quasi-static disturbances are eliminated. The pressure measurement is therefore no longer affected by mechanical misadjustment of the sensor, any variation in the eccentricity of the mountings of the impression cylinder, or any zero-point shift in the sensor or its associated electronics. By this method it is also possible, in a two-color rotary press, to sample the printing pressure over a number of phase intervals to discriminate between the pressure applied by the top ink transfer cylinder and the pressure applied by the bottom ink transfer cylinder, so that these pressures can be controlled independently of one another.

For controlling the printing pressure, the differential value is compared with a predetermined set-value and the deviation between the two is used as the control signal. To reduce any influence of uncorrelated signal variations and to show more clearly the tendency of a variation in pressure, the differential value is preferably compared to the set-value on a revolution by revolution basis, but the control signal is adjusted or updated based upon the differential value only in the event of recurring co-directional deviation from the set-value.

In accordance with a further refinement of the invention, it is also possible to suppress dynamic disturbances. The differential value is averaged over a time duration including several revolutions of the impression cylinder to reduce the requirements for analog signal filtering, hum suppression and sensor mounting stability.

According to another aspect of the invention, the susceptibility to disturbances is further reduced by detecting and averaging a number of sensor signals during the loading and relieving phases of the impression cylinder before the differential value is obtained. This averaging occurs over the printed form including the blank matter area and is particularly desirable for use with uncorrelated form. In addition, the sampling and averaging is performed over selected phases of the impression cylinder so that speed-dependent overswing of the impression cylinder during the loading and relieving surges will not interfere with the detection of the pressure control signal.

BRIEF DESCRIPTION OF THE DRAWING

These and other objects and advantages of the invention will become apparent upon reading the attached detailed description and upon reference to the drawings in which:

FIG. 3 is a curve or trace of the printing pressure between a single ink transfer cylinder and an impression cylinder during printing on a stream of sheets;

FIG. 4 is a schematic diagram of a measuring device and pressure control according to the invention;

While the invention has been described in connection with certain preferred embodiments, it will be understood that we do not intend to be limited by the embodiments shown, but we intend, on the contrary, to cover the various alternative and equivalent constructions including within the spirit and scope of the appended claims.

DESCRIPTION OF THE PREFERRED EMBODIMENTS

Figure 1:
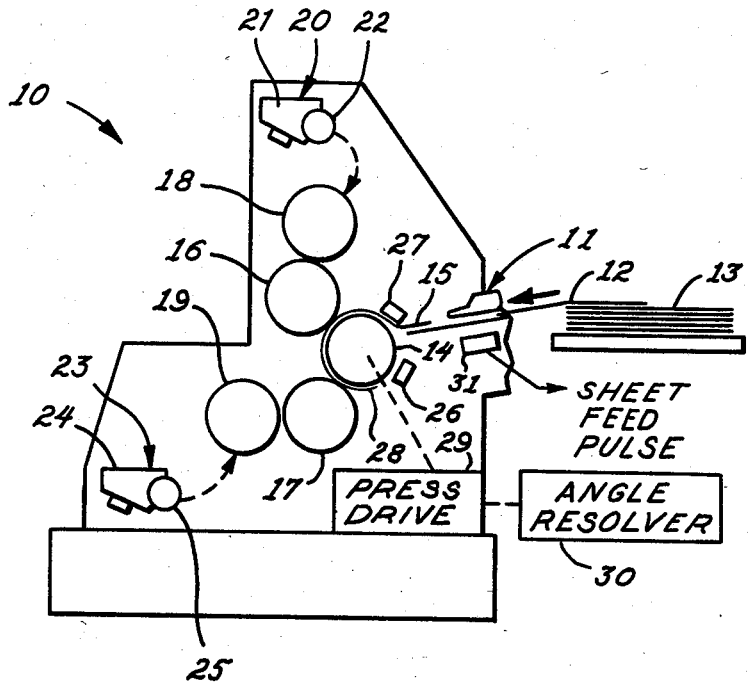
FIG. 1 is a schematic diagram of a two-color offset printing machine.

Turning now to the drawings, there shown in FIG. 1 a schematic diagram of a two-color sheet-fed offset printing press generally designated 10. For printing text on individual sheets, a sheet feeder generally designated 11 successively pulls sheets 12 from a pile 13 and feeds them to an impression cylinder 14. As shown in FIG. 1, a single sheet 15 becomes wrapped around the impression cylinder 14 and passes between a top ink transfer cylinder 16 and a bottom ink transfer cylinder 17. For offset printing, the ink transfer cylinder 16 does not carry the printing form or plate which defines the printed matter. Instead, the printing plate is carried on another cylinder, called the plate cylinder, and the ink transfer cylinder is covered with a resilient blanket which picks up ink from the printing plate and carries the ink to the impression cylinder.

For the two-color printing press 10 shown in FIG. 1, a separate printing plate is provided for each of the two colors. Therefore, an upper plate cylinder 18 carries a first printing plate which transfers ink of a first color to a cooperating blanket cylinder 16, and a second printing plate for the second color is provided on a bottom plate cylinder 19 cooperating with a bottom blanket cylinder 17. The source of the ink for the first color is provided by a top inking unit generally designated 20 including an ink duct or trough 21 cooperating with a duct roller 22 to define an ink reservoir of the first color. Similarly, a bottom inking unit 23 has an ink duct 24 and a duct roller 25 to provide a reservoir of ink of the second color. Intermediate rollers (not shown) transfer ink from the duct rollers 22, 25 to their respective plate cylinders 18 and 19.

In general, in a rotary printing machine the ink is transferred from an ink transfer cylinder to the surface of paper carried by the impression cylinder. During this printing process, the pressure between the impression cylinder and the ink transfer cylinder must be kept within limits to insure uniform printing quality. For this purpose, two pressure sensors 26, 27 could be provided for the printing machine 10 in order to detect the respective printing pressures between the impression cylinder 14 and the respective blanket cylinders 16, 17.

A further complexity is that the stream of sheets 13 is discontinuous through the nips between the impression cylinder 14 and each of the blanket cylinders 16, 17. This is not due to an interruption in the supply of sheets; rather, this is a consequence of the fact that the impression cylinder 14 includes grippers 28 to hold the leading edge of the sheet 15 taken up by the impression cylinder. Therefore, as the sheets 15, 12 pass between the impression cylinder 14 and each of the blanket cylinders 16, 17, there is a gap in the sheet stream between the trailing edge of the first sheet 15 and the leading edge of the successive sheet 12. As this gap passes between the impression cylinder 14 and each of the blanket cylinders 16, 17, the printing pressure or load on the impression cylinder 14 is temporarily relieved.

So that a pressure control system does not respond to this temporary loss of printing pressure, it is known to sample the signal from a pressure sensor only when the printing pressure is applied, for example, during the phase of the impression cylinder corresponding to the maximum printing pressure. The cylinders 14, 16, 17, 18 and 19 in the printing machine 10 are driven by a press drive 29, and an angle resolver or selsyn is also connected to the press drive 29 to indicate the phase angle of the impression cylinder 14. The particular phase at which the sheet 12 is introduced to the impression cylinder 14 is indicated by a sheet feed pulse generated by a sheet feeder control 31. Therefore, the sensors 26 and 27 can be sampled in response to the sheet feed pulse and based upon the indication of the angle resolver 30 in order to obtain the maximum values of printing pressure for both the top and bottom impression cylinders 16, 17.

Figure 2:
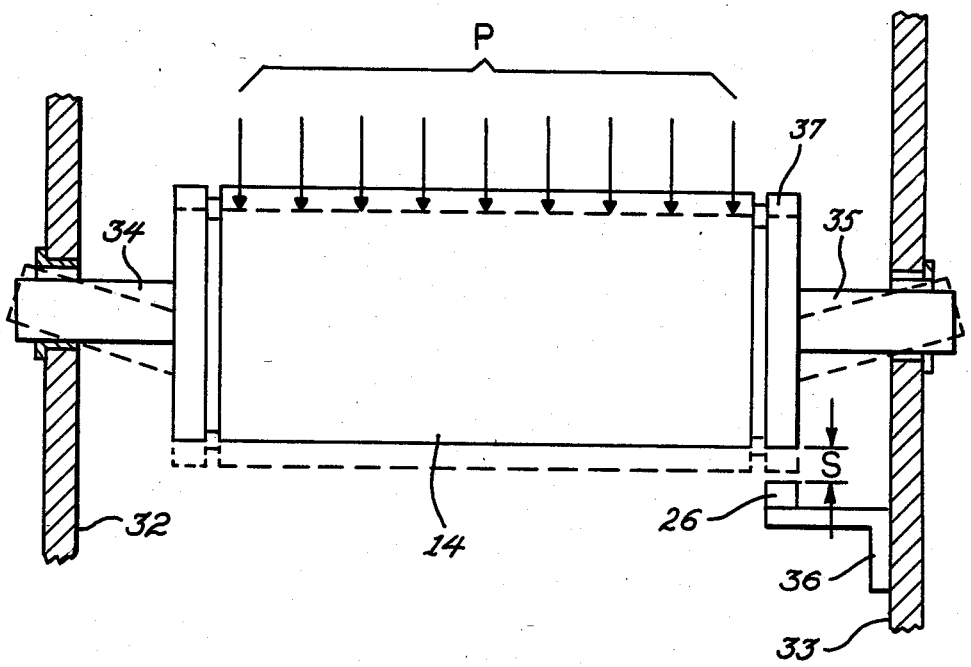
FIG. 2 shows a proximity sensor being used for detecting the printing pressure on an impression cylinder.
Figure 7:
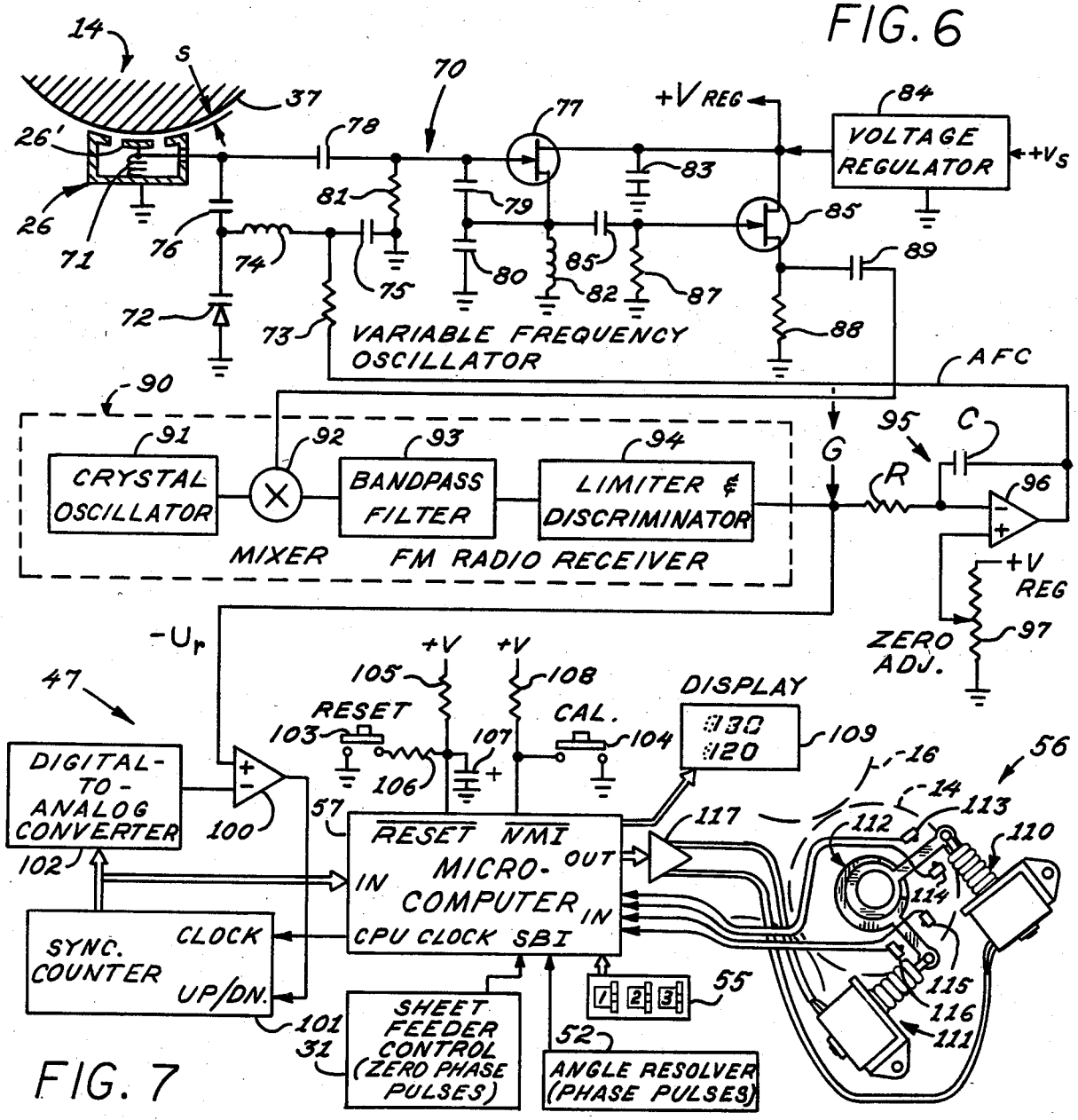
FIG. 7 is a detailed diagram of an embodiment of the invention employing a microcomputer.

Turning now to FIG. 2, the pressure sensor 26 is shown as a proximity sensor responsive to displacement of the impression cylinder 14. The impression cylinder 14 is rotatably mounted to the side columns or walls 32, 33 of the printing machine 10 via trunnions or journals 34, 35. The proximity sensor 26 is secured to the side column 33 by means of a bracket 36 and is situated at a distance s from the bearer 37 of the impression cylinder 14. The proximity sensor, as further described below in connection with FIG. 7, is of the kind which delivers a voltage proportional to the distance s.

As the sheet 15 passes between the impression cylinder 14 and the blanket cylinder 16 (shown in FIG. 1), the impression cylinder is subject to the action of printing forces P from the blanket cylinder 16 and the trunnions 34, 35 will deflect slightly so that the impression cylinder 14 moves radially, thereby reducing the distance s between the bearer 37 and the sensor 26. The deflection of the trunnions 34, 35 and the radial shift of the impression cylinder 14 is shown in broken lines in FIG. 2 and is greatly exaggerated for the sake of illustration. It is apparent that the variation in the distance s is an indication of the resilient deflection of the trunnions 34, 35 and hence of the pressure P acting on the impression cylinder 14. The reduction of the distance s increases the output voltage of the proximity sensor 26.

Turning now to FIG. 3, there is shown a curve or trace 40 of the output voltage U of the sensor 26 as a function of time t. To obtain the trace 40, the sensor 26 is mounted as shown in FIG. 1 so as to be unresponsive to printing pressure from the bottom blanket cylinder 17. The plateaus 41 of high voltage values denote the passage of the sheets between the impression cylinder 14 and the blanket cylinder 16, and the low voltage values or valleys 42 denote the absence of the sheets between these cylinders. The extreme voltage peaks 43 denote the moment of load application to the impression cylinder. The voltage deflections or fluctuations following these voltage peaks 43 are produced primarily by overswing of the impression cylinder after the application of the printing pressure. Similarly fluctuations 44 occur when the printing pressure is relieved from the impression cylinder.

In accordance with a basic aspect of the present invention, the sensor signal or voltage is evaluated during the time intervals when sheets are not engaged between the impression cylinder and the blanket cylinder. As specifically shown in FIG. 4, the voltage signal U from the sensor 26 is fed via an analog-to-digital converter 47 to an electronic evaluator unit 48 controlled by a clocking device 49. In response to the clocking device 49, the electronic evaluator unit 48 samples the voltage signal U only during specific time intervals 45, 46, 50 and 51. A clocking device 49 receives the signal from the angle resolver 30 connected to the impression cylinder 14. The clocking device 49 also receives sheet feed pulses from the sheet feeder or movement control 31. An amplifier 53 amplifies the sampled values and feeds them to a pressure controller 54 in which an average differential value is formed from the sampled values obtained over the intervals 45, 46 and 50, 51, respectively, for comparison with set-values obtained from a set-value transmitter 55. If the average differential value substantially exceeds or under shoots the set-values, then the pressure controller 54 commands the actuator 56 to increase or lower the printing pressure accordingly. As will be further described below in connection with FIGS. 7 to 10, a microcomputer 57 preferably embodies the clocking device 49, the electronic evaluator unit 48, the amplifier 53, and the pressure controller 54.

As will be apparent from FIG. 3, the pressure control system of FIG. 4 can eliminate numerous disturbances which have had an adverse effect on accurate monitoring of the printing pressure. For example, a movement of the zero-point of the sensor, as indicated by the broken line 57 in FIG. 3, whether due to mechanical misadjustment of the sensor or zero-point drift due to electrical causes, has no effect on the operation of the control system, because it is only the sensor voltage difference $\Delta U$ that is determined. For the same reason, the control system is not disturbed by any eccentric shift of the trunnions 34, 35 in the press side columns 32, 33 (see FIG. 2). Dynamic disturbances produced by the overswing of the impression cylinder 14 are suppressed by the repeated short-duration sampling of the sensor voltage and by combining the sampled values from a plurality of cylinder revolutions. These methods similarly suppress dynamic disturbances due to hum and other electronic interference in the signal transmission.

Figure 5:
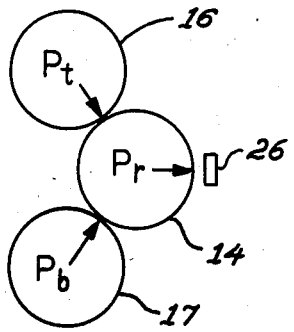
FIG. 5 is a schematic diagram showing the use of a single pressure sensor responsive to the pressure resulting from both the top and the bottom ink transfer cylinders in a two-color rotary printing machine.
Figure 6:
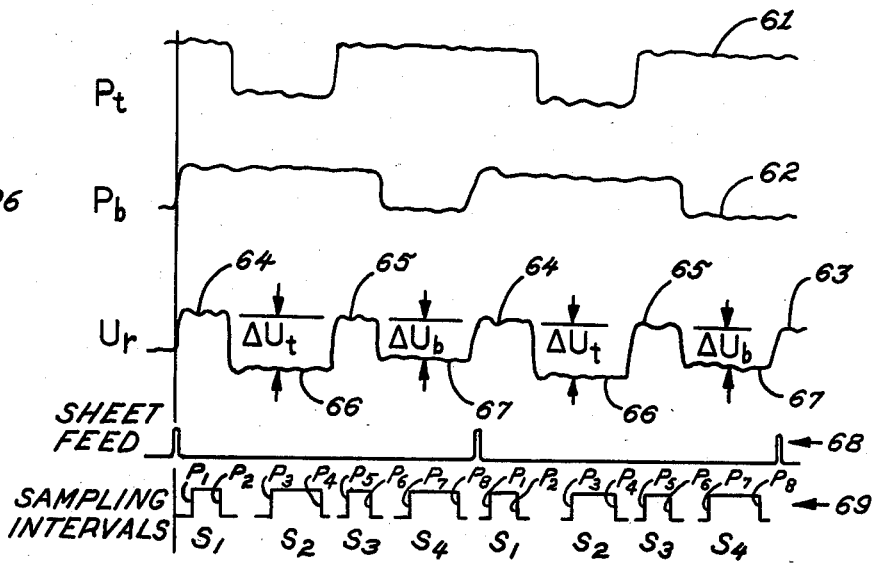
FIG. 6. is a timing diagram showing the sampling of the pressure signal in FIG. 5 to resolve the pressure signal into separate differential values indicating the respective printing pressure from the top and the bottom ink transfer cylinders.

Turning now to FIG. 5 there is shown a schematic diagram illustrating that a single pressure sensor 26 can sense the resultant force $P_r$ due to the printing pressure $P_t$ from the top blanket cylinder 16 and the pressure $P_b$ from the bottom blanket cylinder 17 in the two-color printing press of FIG. 1. In FIG. 6 there is shown a trace 61 of the pressure $P_t$ as well as a trace 62 of the pressure $P_b$. These traces are similar to the trace 40 of FIG. 3 except that the top trace 61 leads the bottom trace 62 by approximately 90° due to fact that the top blanket cylinder 16 is displaced by about 90° from the bottom blanket cylinder 17, with respect to the impression cylinder 14. The trace 63 of the sensor signal $U_r$ is responsive to the resultant pressure $P_r$ and therefore has plateaus 64 and 65 of approximately the same maximum value but has valleys 66 and 67 of different depths corresponding to the respective pressure signals $P_t$ and $P_b$.

It should now be apparent that the method of the present invention can be used to independently measure and control the printing pressure from both the top and bottom blanket cylinders 16, 17. For this purpose, the clocking device 49 is synchronized by the sheetfeed pulses generally designated 68 to provide four different sampling intervals generally designated 69. As will be further described below, the computation of the differential values $\Delta U_t$ and $\Delta U_b$ is simplified by selecting sampling intervals such that the second and fourth sampling intervals $S_2$ and $S_4$ have the same duration, and the first and third sampling intervals $S_1$ and $S_3$ have half the duration of the intervals $S_2$ and $S_4$.

A specific embodiment of the present invention is shown in FIG. 7. The proximity sensor 26 is a contactless proximity sensor detecting the distance s via the electrical capacitance between the sensor's head 26' and the bearer 37 of the impression cylinder 14. This capacitance is part of the tuned circuit for a variable frequency oscillator generally designated 70. The variable frequency oscillator 70 is a conventional VHF oscillator employing junction field-effect transistors, such as part number MPF102, in the common drain configuration. The tuned circuit of the oscillator 70 includes an inductor or coil 71. The variable frequency oscillator 70 is electronically tunable by an automatic frequency control line (AFC) which reverse bias a varactor diode 72 through an isolation resistor 73, an 8.2 microhenry choke inductor 74, and an RF bypass capacitor 75. The resistor 73 has a value, for example, of 2.2K ohms and the capacitor 75 has a value of 0.01 microfarads. The varactor 72 is coupled to the coil 71 through a five picofarad capacitor 76. The coil 71 is coupled to the gate of a first field effect transistor 77 through a fifty picofarad capacitor 78. To provide positive feedback for sustained oscillations, the tuned circuit also includes a capacitive voltage divider including a fifteen picofarad capacitor 79 and a seventy-five picofarad capacitor 80. The first field-effect transistor 77 is biased by a 56K ohm resistor 81 and the output of the transistor 77 is isolated from ground by an 8.2 microhenry choke 82.

So that the frequency of the oscillator 70 is independent of the supply voltage $V_s$, the drain of the field-effect transistor 77 is bypassed to ground through a 0.01 microfarad capacitor 83 and is fed with a regulated voltage $V_{REG}$ supplied by an integrated circuit voltage regulator 84 such as RCA Corporation part number CA3085. The supply voltage $V_s$ is, for example, 12 volts and the regulated voltage $V_{REG}$ is 9 volts. To further ensure the stability of the oscillator 71, the output of the first field-effect transistor 77 is buffered by a second field-effect transistor 85. The two transistors are coupled together via a fifteen picofarad capacitor 86. A 56K ohm resistor 87 biases the gate of the transistor 78 and the output of the transistor 85 is provided across a load resistor 88 having a value of 220 ohms. The output of the variable frequency oscillator is obtained through a coupling capacitor 89 of fifty picofarads.

The variable frequency oscillator 71 indicates the distance s via its frequency of oscillation. To detect the frequency of oscillation, a conventional narrow-band FM radio receiver is used including a crystal oscillator 91, a mixer 92, a bandpass filter 93, and a limiter and discriminator 94. The limiter and discriminator 94 is preferably a phase-shift discriminator such as RCA Corporation part number CA2111AE. Using a standard 455 kilohertz bandpass filter 93, a very high sensitivity is obtained. The variable frequency oscillator 70 operates at about 40 megahertz so that the FM radio receiver will have an output that is very sensitive to the distance s. In order to increase the detectable range of oscillation of the variable frequency oscillator 70, the automatic frequency control signal AFC is provided by a charge pump integrator generally designated 95. The integrator 95 includes an operational amplifier 96, such as RCA Corporation part number CA3140, having a positive input biased by a 10K ohm potentiometer 97 energized by the regulated voltage $V_{REG}$. The time constant of the integrator 95 is set by the series resistance R and the feedback capacitance C. The lower cut-off frequency of the sensor 26 with respect to the discriminator output signal $-U_r$, however, is a function of the open loop gain G from the AFC line according to the equation $f=G/2\pi RC$. For an open loop gain G of 10, a 1 hertz cut-off frequency, corresponding to a minimum machine speed of 1 revolution per second, is obtained by using a resistance R of 10 megohms and a capacitance C of 0.15 microfarads. The potentiometer 97 should be adjusted so that the zero-point of the output of the limiter and discriminator 94 is at its mid-range point.

The output of the limiter and discriminator 94 is the complement of voltage signal $-U_r$. This voltage signal $-U_r$ is sampled by a tracking-type analog-to-digital converter generally designated 47 which includes a high speed comparator 100, such as RCA Corporation part number CAIII, a synchronous binary counter 101 such as RCA part number 4029, and a digital-to-analog converter 102 such as Signetics Corporation LMDAC08CN. The microcomputer 57 is provided with a reset switch 103 for running a normal procedure and also a calibration switch 104 for running a calibration procedure as a non-maskable interrupt. The reset switch 103 works in conjunction with a pull-up resistor 104 of 100K ohms, a series resistor 106 of 220 ohms, and a power-on-reset capacitor 107 of 5 microfarads. The calibration switch 104 works in conjunction with a pull-up resistor 108 of 22K ohms. The microcomputer 57 has single bit inputs (SBI) accepting zero phase pulses from the sheet feeder control 31 and phase pulses from the angle resolver 52. The angle resolver 52 is, for example, a magnetic pick-up coil sensing the passage of teeth on a press drive gear. The set-point transmitter 55 comprises a number of thumbwheel switches.

The microcomputer 57 has a display 109 for displaying the values of the printing pressure from both the top blanket cylinder 16 and the bottom blanket cylinder 17. The actuator 56 includes separate motors and lead screws 110, 111 for independently adjusting the printing pressure for the top and bottom blanket cylinders 16, 17. The printing pressures are adjusted by displacing the axis of the impression cylinder 14 via eccentric mounts generally designated 112. The ends of travel of the lead screws 110, 111 are sensed by limit switches 113, 114, 115, and 116. The power for driving the stepper motors 110, 111 is provided by a driver 117.

Figure 8:
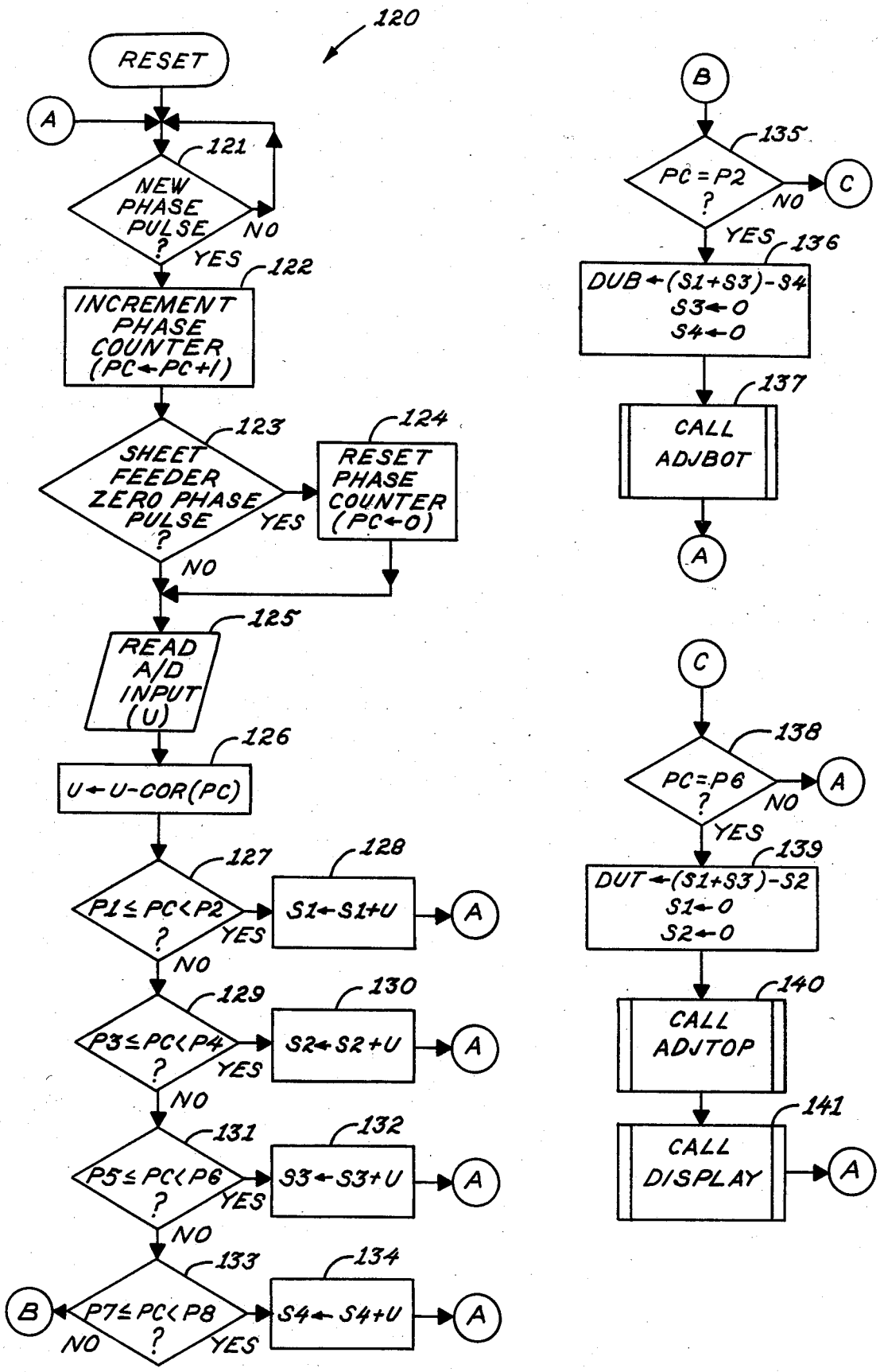
FIG. 8 is a flowchart of an executive procedure executed by the microcomputer in FIG. 7 to perform the clocking, electronic evaluator, and pressure controller functions.
Figure 9:
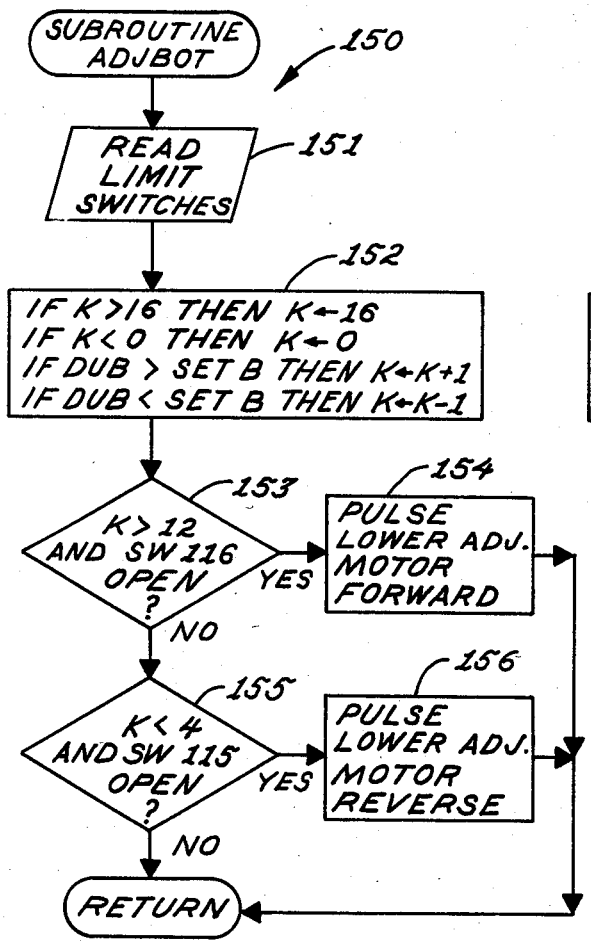
FIG. 9 is a flowchart of a subroutine for adjusting the printing pressure of a bottom ink transfer cylinder.

Turning now to FIG. 8, there is shown a flowchart generally designated 120 of an executive procedure executed by the microcomputer 57 (FIG. 7) in order to perform the method of the present invention. In the first step 121 the microcomputer waits until a new phase pulse is received from the angle resolver 52 (FIG. 7). When a new phase pulse is received, a phase counter (PC) is incremented in step 122. The phase counter, therefore, represents the angular position of the impression cylinder 14. The zero phase position, however, is defined in steps 123 and 124 by resetting the phase counter (PC) to 0 when a sheet feed or zero phase pulse is received from the sheet feeder control 31 (FIG. 7). Next in step 125 the output of the analog-to-digital converter 47 is read into a memory location (U). This sampled value is corrected in step 126 by subtracting a phase dependent correction COR(PC) which is further described below in connection with FIG. 12.

The sampled value (U) is accumulated or averaged over the sampling intervals $S_1$, $S_2$, $S_3$, and $S_4$ as shown in FIG. 6. The sampling intervals are defined by predetermined phase points $P_1$, $P_2$, $P_3$, $P_4$, $P_5$, $P_6$, $P_7$ and $P_8$. In order to determine whether the sampled value (U) occurs within one of the sampling intervals, the phase counter (PC) is compared to the predetermined phase points defining the sampling intervals. In step 127 the value of the phase counter is compared to the value of the first and second phase points to determine whether the sampled value (U) is within the first sampling interval $S_1$. If so, then in step 128 the sampled value (U) is accumulated in an accumulator (S1) for the first sample interval $S_1$. Similarly, in step 129 the value of the phase counter is compared to the value of the third and fourth phase points to determine whether the sampled value (U) was obtained during the second sampling interval and if so, then in step 130 the sampled value (U) is accumulated in a second accumulator (S2) for the second sampling interval. Likewise, in step 131 the value of the phase counter is compared to the values of the fifth and sixth phase points to determine whether the sampled value (U) was obtained during the third sampling interval, and if so in step 132 the sampled value (U) is accumulated in a third accumulator (S3). Moreover, in step 133 the value of the phase counter is compared to the values of the seventh and eighth phase points to determine whether the sampled value (U) was received during the fourth sampling interval, and if so then in step 134 the sampled value is accumulated in a fourth accumulator (S4).

The differential values are computed at the second and sixth phase points. In step 135 the value of the phase counter (PC) is compared to the value of the second phase point (P2) and if the values are equal, then the differential value $\Delta U_b$ (DUB) is computed as the difference between the sum of the first and third accumulators (S1+S3) and the fourth accumulator (S4). In this connection it should be recalled that the duration of each of the first and third sampling intervals is one half of the duration of the fourth sampling interval. Therefore, a division step is not required to normalize the accumulated values. Also in step 136 the third and fourth accumulators are cleared. In step 137 the differential value (DUB) is used for adjusting the printing pressure between the bottom blanket cylinder 17 and the impression cylinder 14 by calling a subroutine ADJBOT further described below in connection with FIG. 9.

The printing pressure between the top blanket cylinder 16 and the impression cylinder 14 is calculated and adjusted in a similar fashion. In step 138 the value of the phase counter (PC) is compared to the value of the sixth phase point (P6). If these values are equal, then in step 139 the differential value $\Delta U_t$ (DUT) is computed as the difference between the sum of the first and third accumulators (S1+S3) and the second accumulator (S2). Also in step 139, the first and second accumulators are cleared. In step 140 a subroutine ADJTOP is called to adjust the printing pressure between the top blanket cylinder 16 and the impression cylinder 14 (see FIG. 5). The subroutine ADJTOP is further described below in connection with FIG. 10. Finally, in step 141, a subroutine DISPLAY is called. The subroutine DISPLAY is described further below in connection with FIG. 11. After step 141, execution returns to the beginning step 121 in order to interate the procedure for the next phase pulse from the angle resolver 52 (FIG. 7).

Figure 11:
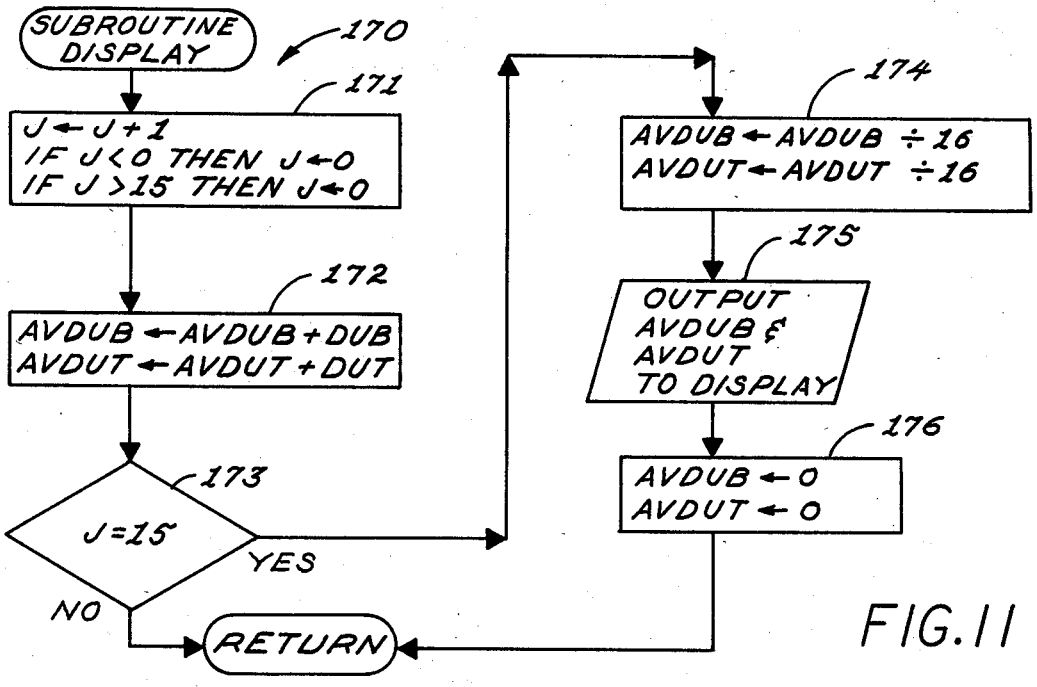
FIG. 11 is a flowchart of a subroutine for averaging the differential values over a number of machine revolutions and displaying the mean values.

Turning now to FIG. 11, there is shown a flowchart generally designated 150 of the ADJBOT subroutine for adjusting the printing pressure between the bottom blanket cylinder 17 and the impression cylinder 14. In the first step 151 the lower limit switches 115, 116 are read (see FIG. 7). Next, in step 152, digital filtering is performed to provide means for generating a control signal in the event of a recurring co-directional deviation from the printing pressure set-value over a number of revolutions of the impression cylinder. As shown in step 152, a counter K keeps track of recurring co-directional deviations for up to 16 revolutions of the impression cylinder. The counter K is first limited to be within the range of 0 to 16, and is then incremented or decremented, respectively, in response to whether the measured printing pressure for the bottom blanket cylinder 14 is greater or less than the set-point pressure, respectively. Recurring positive co-directional deviations are detected in step 153 by comparing the value of the counter K to 12, and if the value of the counter K exceeds 12 and the limit switch 116 is open, then in step 154 the lower adjusting motor 111 (see FIG. 7) is pulsed to drive the motor forward to reduce the printing pressure between bottom blanket cylinder 17 and the impression cylinder 14. Similarly, in step 155, recurring negative co-directional deviations are detected by comparing the value of the counter K to 4. If the value of the counter K is less than 4 and the limit switch 115 is open, then in step 166 the lower adjusting motor 111 is pulsed in a reverse direction to increase the printing pressure between the bottom blanket cylinder 17 and the impression cylinder 14.

Figure 10:
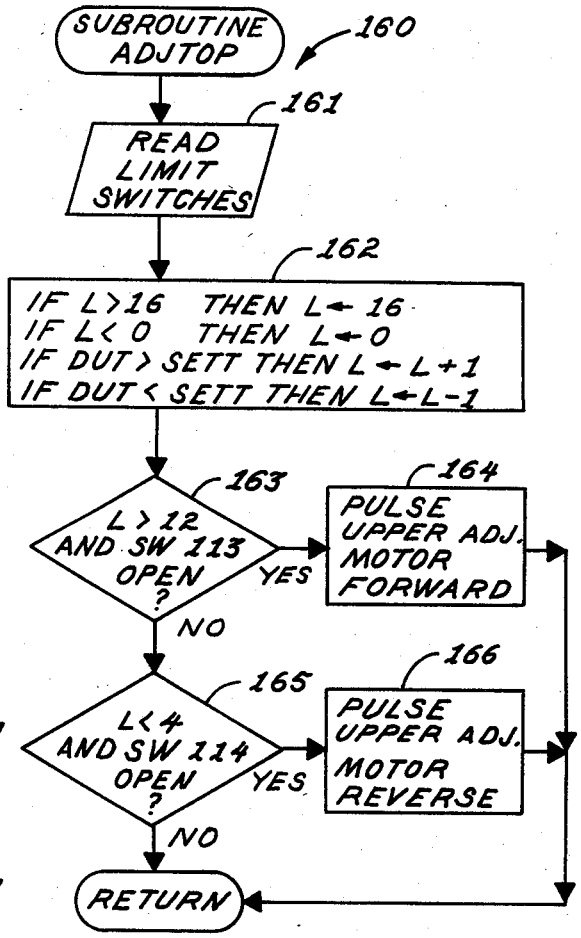
FIG. 10 is a flowchart of a subroutine for adjusting the printing pressure of a top ink transfer cylinder.

Shown in FIG. 10 is a flowchart generally designated 160 of the subroutine ADJTOP for adjusting the printing pressure between the top blanket cylinder 16 and the impression cylinder 14. In step 161 the upper limit switches 113 and 114 are read. Next, in step 162 a digital filtering procedure is again performed to provide means for generating a control signal in the event of a recurring co-directional deviation from the set value over a number of revolutions of the impression cylinder. In this case a counter L keeps track of the co-directional deviations. The value of the counter is limited to within 0 and 16, and is incremented or decremented, respectively, in response to whether the measured printing pressure for the top blanket cylinder 16 (FIG. 5) is greater or less than, respectively, the set-point value for the top blanket cylinder (SETT). In step 163 the value of the counter L is compared to 12 to determine whether the printing pressure for the top blanket cylinder should be decreased. If the value of the counter L exceeds 12 and the limit switch 113 is open, then in step 164 the upper adjusting motor 110 is pulsed forward to decrease the printing pressure. In a similar fashion, in step 165 the value of the counter L is compared to four to determine whether the printing pressure for the top blanket cylinder 16 should be increased. If the value of the counter L is less than four and the limit switch 114 is open, then in step 166 the upper adjusting motor 110 is pulsed in the reverse direction to increase the printing pressure for the top blanket cylinder 16.

Turning now to FIG. 11, there is shown a flowchart generally designated 170 of a subroutine DISPLAY for displaying the mean value of the printing pressures obtained by averaging the differential values over a number of revolutions of the impression cylinder. In the first step 171 a counter J is incremented in modulo-16 fashion. In other words, the counter is first incremented, and then set to 0 if the value of the counter J is found to be outside of the range 0 to 15. The differential values DUB and DUT are accumulated in respective accumulators AVDUB and AVDUT. Then in step 173 the value of the modulo-16 counter J is compared to 15 to determine whether the accumulators have accumulated the differential values over 16 revolutions of the impression cylinder. If not, execution returns. Otherwise, in step 174 the mean values are computed by dividing the values of the accumulators by 16. The division is performed in binary, for example, by right-shifting four binary places. Then in step 175 the mean values in the accumulators are transmitted to the display 109 (see FIG. 7). Finally, the accumulators are cleared in step 176 in anticipation of obtaining the mean values of the differential values for the next 16 revolutions of the impression cylinder 14.

Figure 12:
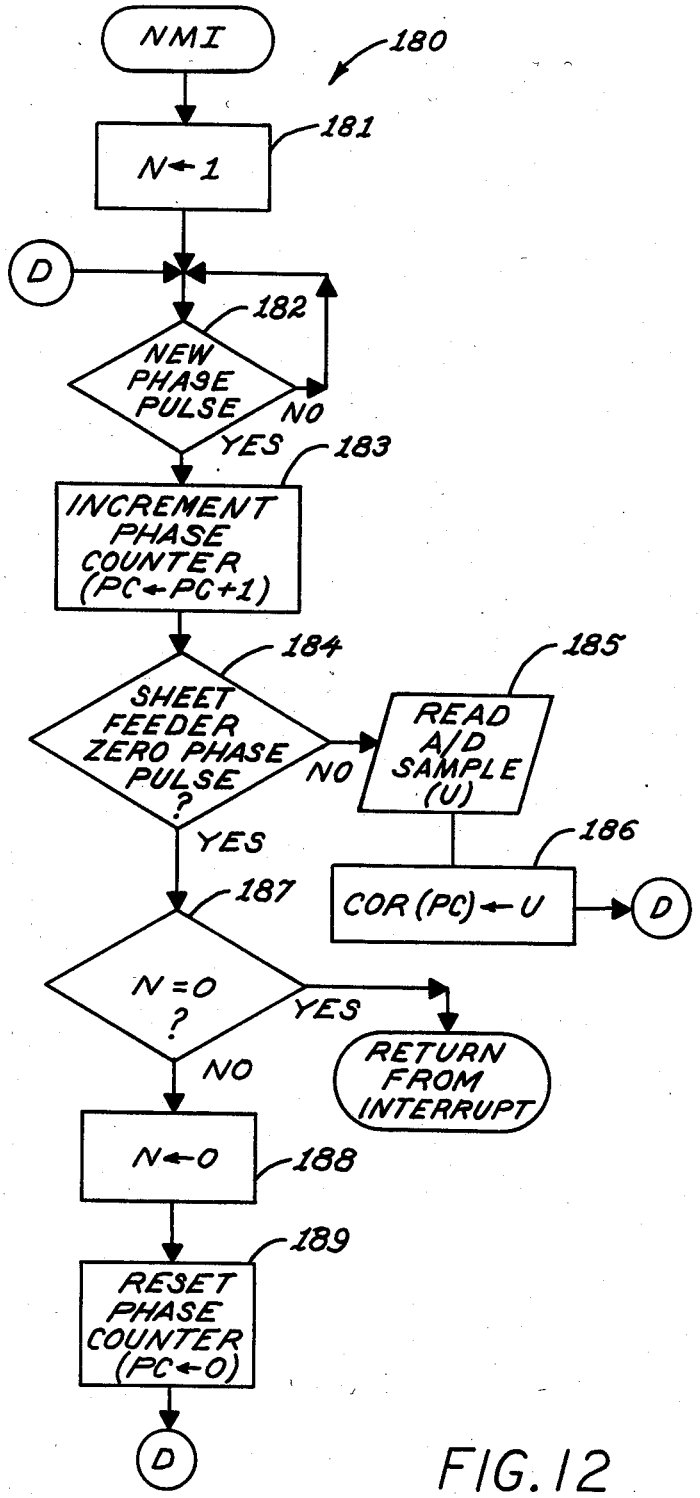
FIG. 12 is a flowchart of a procedure for calibrating a proximity sensor so that it may be used as a pressure sensor.

Turning now to FIG. 12, there is shown a flowchart generally designated 180 of a non-maskable interrupt procedure for calibrating the proximity sensor 26 with respect to phase-dependent deviations. These phase-dependent deviations are caused, for example, by the bearers 37 of the impression cylinder 14 being slightly out-of-round with respect to the axis of the trunnions 34 and 35 (see FIG. 2). The calibration procedure is performed when the printing pressure is set to zero, for example by inhibiting the feeding of sheets and driving the adjusting motors 110, 111 in their forward directions to remove the printing pressure.

In the first step 181 a logical flag N is set to one so that the calibration procedure operates over one revolution of the impression cylinder 14. Next in step 182 execution waits for a new phase pulse. Once a new phase-pulse is received, then in step 183 the phase counter (PC) is incremented. In step 184 the microcomputer looks for a zero phase pulse. If a zero phase pulse is not present, then in step 185 the analog-to-digital converter sample (U) is read and in step 186 the sample is stored in a location of the correction array COR indicated by the phase counter PC. Execution then jumps back to step 182. If in step 184 the zero phase pulse was present, then in step 187 the logical flag N is compared to 0. If it is 0, then the correction array COR includes corrections for an entire revolution of the impression cylinder 14. Therefore, execution returns. Otherwise, in step 188 the logical flag N set to 0 to indicate the start of a complete revolution of the impression cylinder 14. In step 189 the phase counter is reset to 0 in response to the zero phase pulse detected in step 184, and execution jumps back to step 182.

In view of the above, a method of measuring the printing pressure in a printing machine has been described which is not affected by disturbances such as wear of the cylinder bearings or journals, variations in machine speed, and zero-point shift in the pressure sensor and its associate electronics. Since the printing pressure is indicated by a differential value, these disturbances are canceled out. These disturbances are further suppressed by averaging or accumulating samples over sample intervals and over a number of revolutions of the impression cylinder. Also, by proper synchronization of the sampling intervals with the feeding of sheets to the impression cylinder, the method can be used in a two-color rotary press for separately determining and independently controlling the pressures from the top and bottom ink transfer cylinders in response to a single sensor at the impression cylinder.

What is claimed is:

1. A method of measuring the printing pressure applied on an impression cylinder of a sheet-fed rotary printing machine by a second cylinder, the fed sheets being fed between the impression cylinder and said second cylinder, the printing pressure being measured by a sensor having an output signal responsive to said pressure applied on the impression cylinder by said second cylinder, wherein the improvement comprises the steps of:

sensing the phase of said impression cylinder with respect to the feeding of the sheets, in response to the phase of said impression cylinder reaching a first predetermined phase at which said fed sheets are engaged between said impression cylinder and said second cylinder so that said printing pressure is applied to said sheets, obtaining a first value of output signal of said sensor, in response to the phase of said impression cylinder reaching a second predetermined phase at which said fed sheets are not engaged between said impression cylinder and said second cylinder so that said impression cylinder is relieved of said printing pressure, obtaining a second value of the output signal of said sensor, and obtaining the value of the printing pressure in response to the difference between said first value and said second value.

2. The method as claimed in claim 1, further comprising the step of displaying said value of the printing pressure.

3. The method as claimed in claim 1, further comprising the step of comparing said value of the printing pressure to a set-value to generate a deviation signal.

4. The method as claimed in claim 3, wherein said deviation signal is generated for each of a number of successive revolutions of said impression cylinder, and said method further comprises generating a control signal in the event of a recurring co-directional deviation from the set-value over said number of revolutions of said impression cylinder.

5. The method as claimed in claim 1, wherein said value of printing pressure is obtained for each of a number of successive revolutions of said impression cylinder, and said method further comprises averaging the values of printing pressure for said number of revolutions to obtain a mean value.

6. The method as claimed in claim 1, wherein the respective steps of obtaining said first and second values of the output signal of said sensor include sampling the output signal a number of times and averaging the samples during the time intervals when the individual sheets are respectively engaged and disengaged by the cylinders for each revolution of the impression cylinder.

7. A method of measuring the printing pressure between an ink transfer cylinder and an impression cylinder of a sheet-fed rotary printing machine of the kind wherein a stream of the fed sheets passes between the ink transfer cylinder and the impression cylinder, said printing machine also having a sensor generating an output signal responsive to said pressure applied to said impression cylinder by said ink transfer cylinder, wherein the improvement comprises detecting a first signal responsive to the output signal of said sensor when the impression cylinder is subject to said printing pressure during the passage of the fed sheets between the cylinders for printing, detecting a second signal responsive to the output signal of said sensor when the impression cylinder is relieved of said printing pressure due to gaps in the stream of the fed sheets, and detecting a third signal in response to the differential value between said first and second signals, so that said third signal is a more accurate indication of said printing pressure than said first signal.

8. The method as claimed in claim 7, further comprising the step of displaying said differential value between said first and second signals.

9. The method as claimed in claim 7, further comprising the step of comparing said differential value between said first and second signals to a set-value to generate a deviation signal.

10. The method as claimed in claim 9, wherein said deviation signal is generated for each of a number of successive revolutions of said impression cylinder, and said method further comprises generating a control signal in the event of a recurring co-directional deviation from the set-value over said number of revolutions of said impression cylinder.

11. The method as claimed in claim 7, wherein said differential value between said first and second signals is obtained for each of a number of successive revolutions of said impression cylinder, and said method further comprises averaging said differential values for said number of revolutions to obtain a mean value.

12. The method as claimed in claim 7, wherein the respective steps detecting said first and second signals include sampling the output signal of said sensor a number of times and averaging the samples during predetermined sampling intervals when the sheets are respectively engaged and disengaged by the cylinders for each revolution of the impression cylinder.

13. A control system for regulating the printing pressure between an ink transfer cylinder and an impression cylinder of a sheet-fed rotary printing machine of the kind wherein a stream of the fed sheets passes between the ink transfer cylinder and the impression cylinder for printing, said control system comprising, in combination, sensor means for generating an output signal responsive to said pressure applied to said impression cylinder by said ink transfer cylinder, angle resolver means synchronized to the passage of individual ones of the fed sheets for generating at least one output signal indicating when said sheets are engaged between the cylinders and also indicating when said sheets are not engaged between the cylinders due to gaps in said stream of fed sheets, means for sampling the output signal of said sensor in response to the output signal of said angle resolver means to obtain a first signal by sampling the output signal of said sensor when said sheets are engaged between the cylinders and a second signal by sampling the output signal of said sensor when the sheets are not engaged between the cylinders due to gaps in said stream of fed sheets, means for generating a third signal in response to the differential value between said first and second signals, so that said third signal is a more accurate indication of said printing pressure than said first signal, means for comparing said third signal to a fourth signal indicating a predetermined value of desired printing pressure in order to generate a pressure control signal, and actuator means responsive to said pressure control signal for adjusting said printing pressure.

14. The control system as claimed in claim 13, wherein said means for sampling the output signal of said sensor comprises an analog-to-digital converter and means for accumulating digital values from said analog-to-digital converter over sampling intervals between predefined phase points indicated by said angle resolver means including a first sampling interval for obtaining said first signal when said sheets are engaged between the cylinders and a second sampling interval for obtaining said second signal when the sheets are not engaged between the cylinders due to gaps in said stream of fed sheets.

15. The control system as claimed in claim 13, wherein said means for comparing said third signal to a fourth signal in order to generate a pressure control signal includes means for comparing said third signal to said fourth signal for each of a number of successive revolutions of said impression cylinder, and means for generating said pressure control signal in the event of a recurring co-directional deviation of said third signal from said fourth signal over said number of revolutions of said impression cylinder.

* * * * *